US008881662B2

(12) United States Patent
Yamada et al.

(10) Patent No.: US 8,881,662 B2
(45) Date of Patent: Nov. 11, 2014

(54) FLUIDIZED BED INCINERATOR AND FLUIDIZED BED INCINERATING METHOD FOR SLUDGE USING THE SAME

(75) Inventors: Masaki Yamada, Minato-Ku (JP); Tetsuya Yanase, Minato-Ku (JP); Masayuki Yamamoto, Minato-Ku (JP); Tomoyuki Takeshita, Minato-Ku (JP); Kosuke Kamiya, Minato-Ku (JP)

(73) Assignee: Metawater Co., Ltd., Minato-ku (JP)

( * ) Notice: Subject to any disclaimer, the term of this patent is extended or adjusted under 35 U.S.C. 154(b) by 865 days.

(21) Appl. No.: 12/758,166

(22) Filed: Apr. 12, 2010

(65) Prior Publication Data

US 2010/0192816 A1 Aug. 5, 2010

Related U.S. Application Data

(63) Continuation of application No. PCT/JP2008/070180, filed on Nov. 6, 2008.

(30) Foreign Application Priority Data

Nov. 7, 2007 (JP) ..... 2007-289241
Mar. 13, 2008 (JP) ..... 2008-063463

(51) Int. Cl.

| | |
|---|---|
| ***F23G 5/00*** | (2006.01) |
| ***F23G 7/00*** | (2006.01) |
| ***F23G 7/04*** | (2006.01) |
| ***F23G 5/12*** | (2006.01) |
| ***F23G 5/14*** | (2006.01) |
| ***F23G 5/30*** | (2006.01) |
| ***F23G 5/50*** | (2006.01) |

(52) U.S. Cl.

CPC ..... *F23G 5/50* (2013.01); *F23G 2207/60* (2013.01); *F23G 2203/502* (2013.01); *F23G 5/30* (2013.01); *F23G 2900/50007* (2013.01); *F23J 2215/101* (2013.01); *F23G 7/001* (2013.01); *F23G 2900/54402* (2013.01); *F23G 2202/101* (2013.01); *F23G 2207/30* (2013.01)

USPC ..... 110/346; 110/348; 110/245; 110/238; 110/229

(58) Field of Classification Search

CPC ..... F23G 5/30; F23G 5/50; F23G 7/001; F23G 2202/10; F23G 2202/101; F23G 2207/30; F23G 2207/60; F23G 2209/12; F23G 2900/50007; F23G 2900/54402; F23J 2215/101; C02F 11/10

USPC ..... 110/238, 235, 244, 245, 346, 348, 297, 110/229, 210, 212, 214

See application file for complete search history.

(56) References Cited

U.S. PATENT DOCUMENTS 4,917,027 A * 4/1990 Albertson et al. ..... 110/346
6,168,425 B1 1/2001 Fujinami et al.

(Continued)

FOREIGN PATENT DOCUMENTS

CN 1223715 A1 7/1999
JP 04-155105 A1 5/1992

(Continued)

*Primary Examiner* — Kenneth Rinehart
*Assistant Examiner* — Tavia Sullens
(74) *Attorney, Agent, or Firm* — Burr & Brown, PLLC

(57) ABSTRACT

An inside of an incinerator body into which sludge is fed is divided into a lower portion, a portion above the lower portion, and a top portion in a height direction. The lower portion serves as a pyrolysis zone for supplying fluidizing air having an air ratio of 1.1 or less together with fuel to thermally decompose the sludge while fluidizing the sludge. The portion above the lower portion serves as an over bed combustion zone for supplying only combustion air having an air ratio of 0.1 to 0.3 to form a local high temperature place to decompose $N_2O$. The top portion serves as a perfect combustion zone for perfectly combusting unburned contents. The quantity of $N_2O$ generated during sludge incineration can be drastically reduced while maintaining the use quantity of auxiliary fuel at the same level as that of a conventional incineration method.

15 Claims, 2 Drawing Sheets

(56) References Cited

U.S. PATENT DOCUMENTS

| | | | | |
|---|---|---|---|---|
| 6,789,487 | B2 * | 9/2004 | Torii et al. | 110/345 |
| 6,857,379 | B2 * | 2/2005 | Gross et al. | 110/346 |

FOREIGN PATENT DOCUMENTS

| | | | | |
|---|---|---|---|---|
| JP | 05-071707 | A1 | 3/1993 | |
| JP | 05-340509 | A1 | 12/1993 | |
| JP | 05340509 | A * | 12/1993 | F23C 11/02 |
| JP | 3059995 | B2 | 7/2000 | |
| JP | 2002-147725 | A1 | 5/2002 | |
| JP | 2003-227604 | A1 | 8/2003 | |
| JP | 2005-199157 | A1 | 7/2005 | |
| WO | WO 2006084954 | A1 * | 8/2006 | |

* cited by examiner

FLUIDIZED BED INCINERATOR AND FLUIDIZED BED INCINERATING METHOD FOR SLUDGE USING THE SAME

BACKGROUND OF THE INVENTION

1. Field of the Invention

The present invention relates to a fluidized bed incinerator that can incinerate sludge containing an N content while suppressing the generation of $N_2O$ that is greenhouse gas, and an incinerating method for sludge using the fluidized bed incinerator.

2. Description of Related Art

Since sludge represented by raw sludge contains a large quantity of N contents derived from protein, various kinds of nitrogen oxides are generated by incineration, and are discharged into the atmosphere. Particularly, $N_2O$ (nitrous oxide) of these nitrogen oxides exhibits a Green House effect of 310 times as much as $CO_2$. Therefore, the reduction of $N_2O$ is particularly strongly required.

Fluidized bed incinerators, which hardly generate dioxin, have been widely used for incineration of the sludge. Generally, incineration has been carried out at about 800° C. However, when the incineration temperature is raised to 850° C., it turns out that the quantity of $N_2O$ generated is decreased. This is referred to as a "high temperature incineration method", which is estimated as a method effective for suppressing $N_2O$.

However, it is necessary to increase the use quantity of auxiliary fuel to 1.4 to 1.6 times as much as that of the conventional technique in order to raise the incineration temperature to 850° C. The increase is not preferable in view of energy saving. In addition, a current situation where fuel cost is raised causes drastic increase in running cost. Thus, the "high temperature incineration method" is effective for suppressing $N_2O$ but has problems in practical use.

The problem of the suppression of $N_2O$ is generated even in a fluidizing bed combustion boiler using municipal waste as fuel. Then, Patent Document 1 proposes a multistage combustion method of a fluidizing bed combustion boiler. In the multistage combustion method, the air ratio of a fluidized bed is set to 0.9 to 1.0 to suppress the quantities of $N_2O$ and NOx generated. Additional fuel and combustion air therefor are supplied at the upper stage to carry out high temperature combustion to decompose $N_2O$ at a high temperature. Furthermore, a sufficient quantity of air is blown at the highest stage to carry out perfect combustion.

However, the multistage combustion method of Patent Document 1 requires a large amount of auxiliary fuel in order to supply the additional fuel and the combustion air therefor to the upper stage of the fluidized bed to form a high temperature place, which can decompose $N_2O$. Since the multistage combustion method of Patent Document 1 is related with a boiler, the multistage combustion method can collect the heat quantity of the auxiliary fuel, and the use quantity of the auxiliary fuel does not become a very large problem. However, when the method is applied to a sludge incinerator as it is, the use quantity of the auxiliary fuel becomes a problem, and the method is not always satisfactory in view of the energy saving.

Patent Document 1: Japanese Patent No. 3059995

SUMMARY OF THE INVENTION

The present invention has been developed to eliminate the conventional problem. It is an object of the present invention to provide a fluidized bed incinerator capable of suppressing the quantity of $N_2O$ generated when sludge including an N content is incinerated to a level equal to that in a "high temperature incineration method" and also capable of drastically reducing the use quantity of auxiliary fuel as compared to the "high temperature incineration method". It is another object of the present invention to provide a fluidized bed incinerating method for sludge using the fluidized bed incinerator.

A fluidized bed incinerator for sludge of the present invention developed to eliminate the problem comprises an incinerator body into which the sludge is supplied without drying, wherein an inside of the incinerator body is divided into a lower portion, a portion above the lower portion, and a top portion in a height direction;

the lower portion serves as a pyrolysis zone for thermally decomposing the sludge while supplying fluidizing air having an air ratio of 1.1 or less together with fuel to combust the fuel to fluidize the sludge;

the portion above the lower portion serves as an over bed combustion zone for supplying only secondary combustion air having an air ratio of 0.1 to 0.3 to form a local high temperature place to decompose $N_2O$; and the top portion serves as a perfect combustion zone for perfectly combusting unburned contents.

According to 2, an auxiliary fuel reaction zone for supplying only auxiliary fuel to decompose $N_2O$ can be formed between the over bed combustion zone and the perfect combustion zone. According to 3, an air ratio of the pyrolysis zone can be set to 0.7 to 1.1; a temperature of the pyrolysis zone can be set to 550 to 750° C.; and a temperature of the over bed combustion zone can be set to 850 to 1000° C. According to 4, a total air ratio of primary air supplied as the fluidizing air and secondary air supplied to the over bed combustion zone can be set to 0.1 to 0.3. According to 5, an air ratio in total can be set to 1.5 or less, and more preferably 1.3 or less.

According to 6, a fluidized bed incinerating method for sludge of the present invention comprises the steps of:

feeding the sludge into a fluidized bed incinerator;

thermally decomposing the sludge at a temperature of 550 to 750° C. while fluidizing the sludge in a pyrolysis zone into which fluidizing air having an air ratio of 1.1 or less is supplied together with fuel;

blowing combustion air having an air ratio of 0.1 to 0.3 into pyrolysis gas at a position above the pyrolysis zone to form a local high temperature place of 850 to 1000° C. to decompose $N_2O$ in the pyrolysis gas; and blowing air into a top portion to perfectly combust unburned contents.

Furthermore, according to 7, a fluidized bed incinerating method for sludge, comprises the steps of:

feed the sludge without drying into a fluidized bed incinerator;

thermally decomposing the sludge at a temperature of 550 to 750° C. while fluidizing the sludge in a pyrolysis zone into which fluidizing air having an air ratio of 1.1 or less is supplied together with fuel;

blowing combustion air having an air ratio of 0.1 to 0.3 into pyrolysis gas at a position above the pyrolysis zone to form a local high temperature place of 850 to 1000° C. to decompose $N_2O$ in the pyrolysis gas; and supplying only auxiliary fuel into an auxiliary fuel reaction zone above the position above the pyrolysis zone to decompose residual $N_2O$; and blowing air into a top portion to perfectly combust unburned contents.

According to the present invention, the sludge is fed into the fluidized bed incinerator, and the sludge is thermally decomposed while being fluidized bed in the pyrolysis zone into which the fluidizing air having the air ratio of 1.1 or less is supplied together with the fuel. Since the pyrolysis zone has the air ratio of 1.1 or less and contains little oxygen, the oxidization of the N content cannot advance easily to suppress the generation of $N_2O$. Nevertheless, the sludge is violently agitated at a temperature place of 550 to 750° C. by the fluidizing medium to thermally decompose a combustible content in the sludge sufficiently.

In the present invention, the combustion air having the air ratio of 0.1 to 0.3 is blown into the pyrolysis gas at the position above the pyrolysis zone to form the local high temperature place of 850 to 1000° C. and to decompose $N_2O$ in the pyrolysis gas. However, only air is blown into a portion having a low oxygen concentration to locally combust the pyrolysis gas. Thereby, the over bed combustion zone does not require the auxiliary fuel at all. Although $N_2O$ is mainly generated in a portion above a sand bed, the high temperature place is formed in the generation region of $N_2O$ in the present invention. Thereby, the secondary combustion air is supplied into the portion above the sand bed (from the sand bed to ⅓ of the height of the incinerator). Furthermore, heat release is blocked by feeding the secondary combustion air into the portion above the sand bed to more easily form the local high temperature place. In the present invention, the quantity of the pyrolysis gas discharged from the pyrolysis zone is less than that of combustion exhaust gas in ordinary combustion. Less heat quantity is required for warming, and the high temperature place is local. Furthermore, the temperature of the fluidized bed part is low. Thereby, the use quantity of the auxiliary fuel can be drastically reduced as compared to the "high temperature incineration method". Furthermore, since air is blown into in the top portion to perfectly combust unburned contents, the exhaust gas contains no toxic component.

The pyrolysis zone is operated with the air ratio set to 1.1 or less. However, as the air ratio is reduced, it gradually becomes difficult to hold the temperature of the sand bed. It is difficult to reduce the air ratio to less than 0.8 in an ordinary fluidizing type pyrolysis furnace directly feeding the sludge. However, in the present invention, the local high temperature place is formed at a position above the pyrolysis zone. The radiant heat of the local high temperature place facilitates the temperature holding of the sand bed, and can reduce the air ratio of the pyrolysis zone to about 0.7. Therefore, the air ratio of the entire fluidized bed incinerator can be also reduced. However, when the air ratio of the pyrolysis zone is excessively reduced, fluidizing defect occurs, and toxic gases such as cyanogen and carbon monoxide may be generated. Thereby, the lower limit of the air ratio is about 0.7.

When only the auxiliary fuel is supplied into the auxiliary fuel reaction zone above the over bed combustion zone as in 7, hydrogen in the fuel is radicalized to attack residual $N_2O$ to decompose $N_2O$. Thereby, the generation of $N_2O$ is more surely suppressed. Furthermore, since the required supply quantity of the auxiliary fuel is very small, the use quantity of the auxiliary fuel can be drastically reduced as compared to the "high temperature incineration method" even in this case.

DESCRIPTION OF THE SYMBOLS

Figure 1:
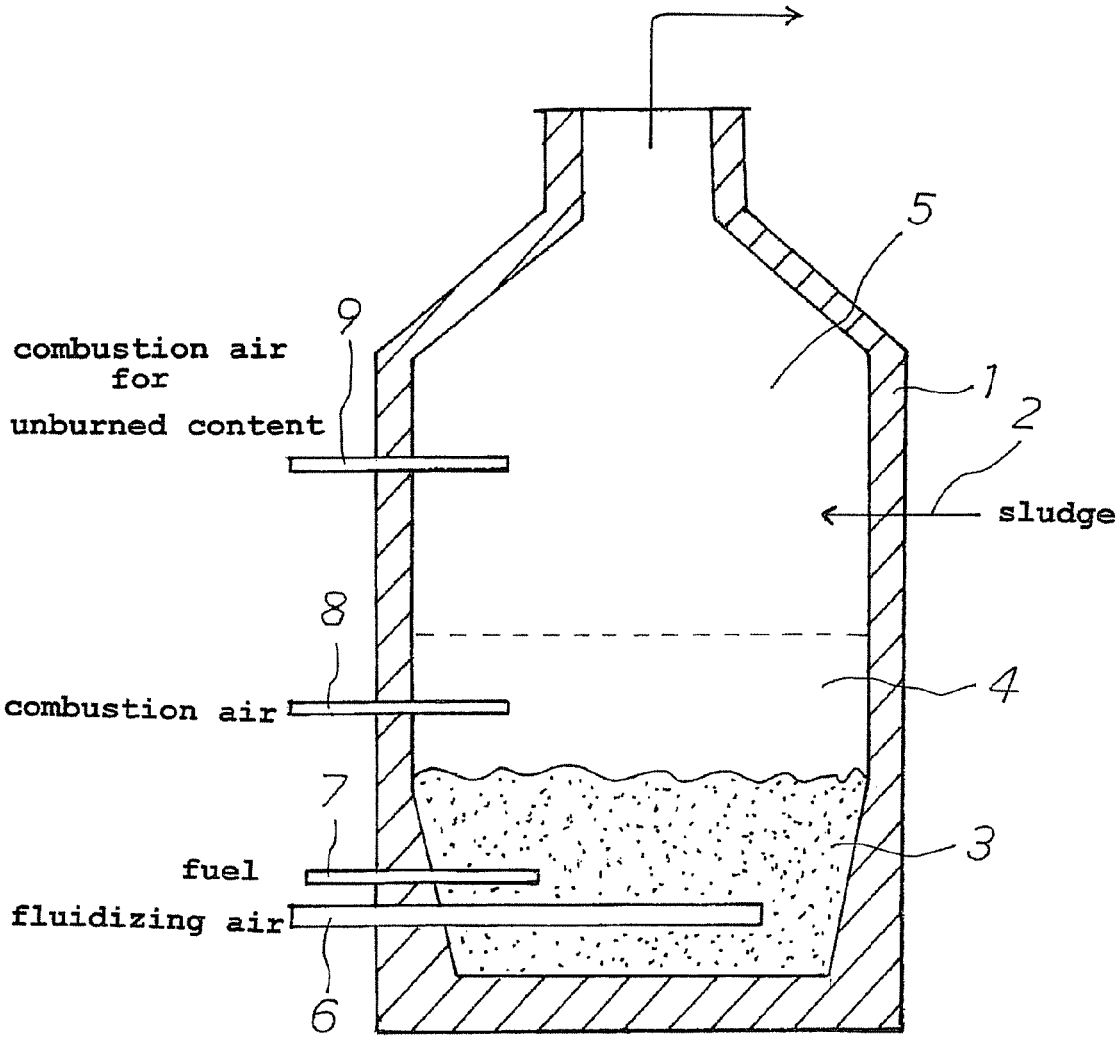
FIG. 1 is a sectional view showing a first embodiment of the present invention.

1: incinerator body of fluidized bed incinerator
2: sludge feed port
3: pyrolysis zone
4: over bed combustion zone
5: perfect combustion zone
6: Primary air supply pipe
7: fuel supply pipe
8: secondary air supply pipe
9: third air supply pipe
10: auxiliary fuel reaction zone
11: second auxiliary fuel supply pipe

DETAILED DESCRIPTION OF THE INVENTION

Hereinafter, preferred embodiments of the present invention will be shown below.

FIG. 1 is a sectional view showing a first embodiment of the present invention. Numeral 1 denotes an incinerator body of a fluidized bed incinerator. Numeral 2 denotes sludge feed port formed in the sidewall of the incinerator body 1. Sludge is supplied without drying into the incinerator body 1 from the feed port 2. The sludge is typically sewage-dewatered sludge. However, the sludge may be stockbreeding sludge, factory sludge, and the like, which contain an N content. In this embodiment, the inside of the incinerator body 1 is divided into three zones in a height direction. The inside of the incinerator body 1 is divided into a pyrolysis zone 3, an over bed combustion zone 4, and a perfect combustion zone 5 in this order from the bottom of the incinerator body 1.

The pyrolysis zone 3, which is a zone formed in the lowest portion of the incinerator body 1, is provided with a primary air supply pipe 6 and a fuel supply pipe 7. Fluidizing air is supplied from the primary air supply pipe 6. The fluidizing air and a known fluidizing medium fluidize the sludge. From the fuel supply pipe 7, auxiliary fuel is supplied, and is combusted by the fluidizing air to maintain the temperature of the pyrolysis zone 3 at 550 to 750° C. The fed sludge is heated while violently agitated by the fluidizing air. As the auxiliary fuel, gases such as town gas and propane gas, or fuel oils such as heavy oil are used.

In the present invention, the supply quantity of the fluidizing air is set so that an air ratio is set to 1.1 or less, preferably 0.7 to 1.1 on the basis of a theoretical air quantity required for combusting the auxiliary fuel and the sludge. Therefore, although the sludge is thermally decomposed, the air ratio is low to cause an insufficient oxygen quantity. Accordingly, the quantity of $N_2O$ generated can be suppressed as compared to the case where the ordinary fluidizing combustion is carried out. As described next, since a local high temperature place is formed at a position above the pyrolysis zone 3 in the present invention, a radiant heat of the local high temperature place facilitates the temperature holding of a sand bed, and the air ratio of the pyrolysis zone can be reduced to about 0.7. When the air ratio is less than 0.7, a heating value caused by partial combustion in a fluidized bed part is less than heat output quantity of sludge moisture evaporation heat, pyrolysis heat, heat release or the like. This complicates the temperature holding of the fluidized bed part, and may generate toxic gases such as cyanogen and carbon monoxide. Therefore, it is preferable that the air ratio is 0.7 or more and 1.1 or less.

The over bed combustion zone 4 is formed at a position above the pyrolysis zone 3. Into the over bed combustion zone 4, only combustion air is supplied from a secondary air supply pipe 8 so as to set an air ratio to 0.1 to 0.3. Pyrolysis gas raised from the pyrolysis zone 3 contacts the air and is combusted to form the local high temperature place (hot spot) having a temperature of 850 to 1000° C. Therefore, $N_2O$ contained in the pyrolysis gas is decomposed in the local high temperature place.

When the air ratio supplied from the secondary air supply pipe 8 is less than 0.1, the local high temperature place of 850 to 1000° C. cannot be formed. When the air ratio is more than 0.3, the air quantity is increased, and it is necessary to supply the auxiliary fuel in order to form the local high temperature place of 850 to 1000° C. Therefore, it is necessary to set the air ratio to 0.1 to 0.3. Thus, the unique characteristic of the present invention is that only a small quantity of air is blown into a reduction atmosphere to form the hot spot to decompose $N_2O$. The present invention has an advantage that it is not necessary to use the auxiliary fuel, which is more than a quantity required for holding the temperature of a fluidized bed. It is preferable that a total air ratio of primary air supplied as the fluidizing air and secondary air supplied to the over bed upper-combustion zone is set to 1.0 to 1.3.

A top portion of the incinerator body 1 is the perfect combustion zone 5 which perfectly combusts unburned contents. An air supply pipe 9 for combusting the unburned content, which is disposed in the perfect combustion zone 5, supplies air. The supply quantity of the air is set so that an air ratio is set to 0.1 to 0.3. The temperature of the perfect combustion zone 5 is 800 to 850° C. $N_2O$ which was not decomposed in the over bed combustion zone 4 is further decomposed, and CO is oxidized into $CO_2$. They are discharged out of the incinerator, and ordinary exhaust gas processing is carried out.

The total of air quantities supplied from the primary air supply pipe 6, the secondary air supply pipe 8 and the air supply pipe 9 for combusting the unburned content is set so that the total air ratio is 1.5 or less, preferably 1.3 or less. Thus, the air ratio is throttled, and the auxiliary fuel is supplied from only the fuel supply pipe 7 of the pyrolysis zone 3. Consequently, the quantity of $N_2O$ generated can be drastically reduced (to ⅓ in examples) as compared to the conventional level while the use quantity of the auxiliary fuel is mostly set to the conventional level. A suppressing effect of $N_2O$ of the present invention is equal to or greater than that of a "high temperature incineration method". However, the use quantity of the auxiliary fuel in the "high temperature incineration method" is 1.4 to 1.6 times as much as the conventional level. Thus, the present invention can suppress the quantity of $N_2O$ generated to a quantity equal to or less than that of the "high temperature incineration method". Furthermore, the present invention can drastically reduce the use quantity of the auxiliary fuel as compared to that of the "high temperature incineration method".

Figure 2:
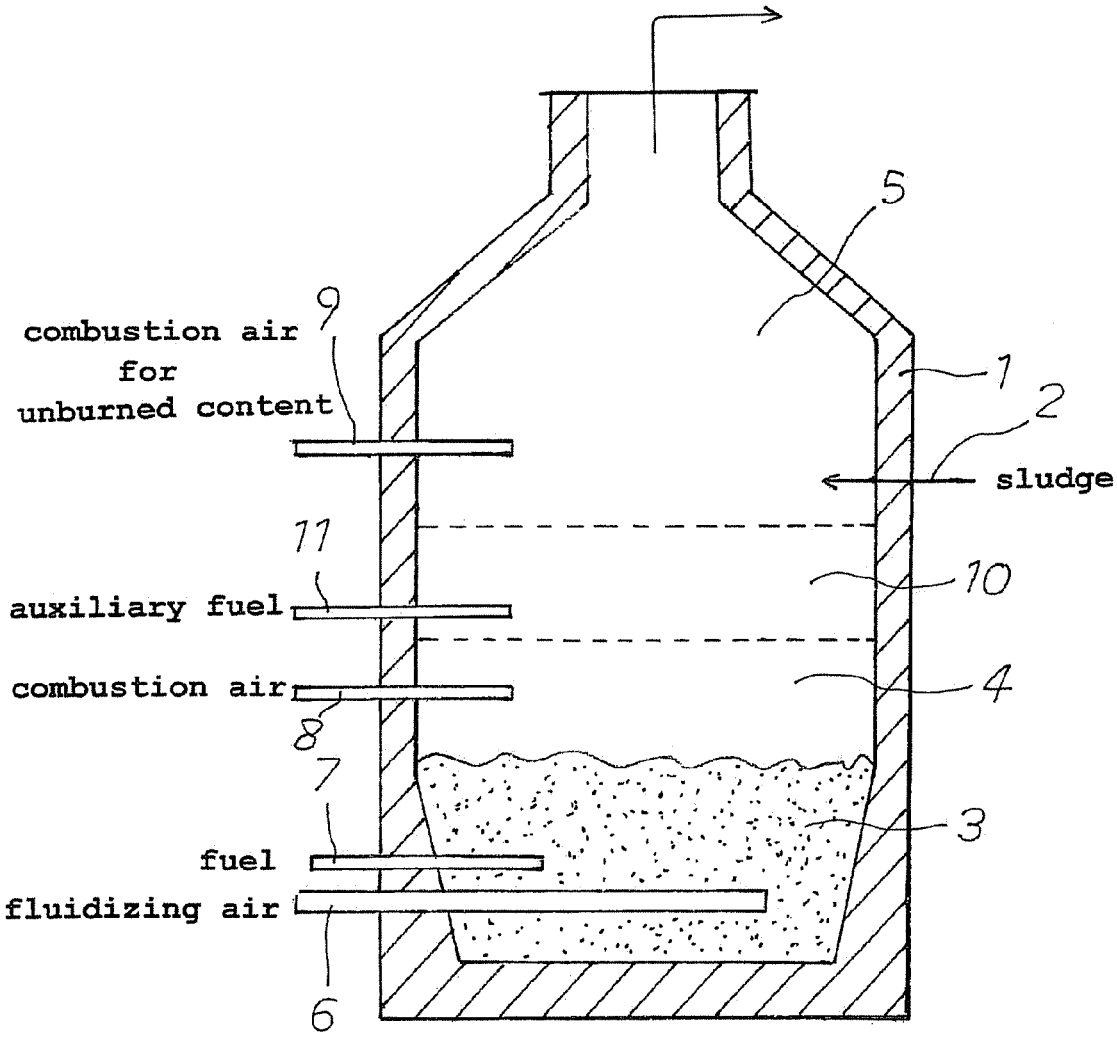
FIG. 2 is a sectional view showing a second embodiment of the present invention.

FIG. 2 is a sectional view showing a second embodiment of the present invention. In FIG. 2, an auxiliary fuel reaction zone 10 is formed between the over bed combustion zone 4 and the perfect combustion zone 5. Into the auxiliary fuel reaction zone 10, only the auxiliary fuel is supplied, and $N_2O$ is decomposed. Thereby, the inside of the incinerator body 1 is divided into four zones in the height direction.

A second auxiliary fuel supply pipe 11 is disposed in the auxiliary fuel reaction zone 10, and a tiny quantity of auxiliary fuel is added through the second auxiliary fuel supply pipe 11. Hydrocarbon as the auxiliary fuel is thermally decomposed to generate hydrogen radicals. The hydrogen radicals attack $N_2O$ contained in the pyrolysis gas of the sludge to decompose $N_2O$. Since a stronger reduction atmosphere is formed in the zone by adding the auxiliary fuel, the generation of $N_2O$ is suppressed.

Thus, the quantity of $N_2O$ generated is further suppressed as compared to the case of the embodiment described above by forming the auxiliary fuel reaction zone 10 (to ¼ as much as the conventional level in examples). In this case, the auxiliary fuel is excessively added as compared to the embodiment described above. However, as described in examples, a small quantity of auxiliary fuel can exhibit a large effect.

Example 1

Incineration experiments of sludge were conducted using a fluidized bed incinerator for an experiment while conditions were changed. The quantity of the sludge fed was 80 kg/h in each of the incineration experiments. As auxiliary fuel, heavy oil was used. The experiments were conducted with respect to the following four kinds: ordinary fluidizing incineration conventionally carried out, high temperature incineration having a high incineration temperature, a method shown in FIG. 1 of the present invention, and a method shown in FIG. 2 of the present invention. In the method shown in FIG. 2 of the present invention, propane gas of a quantity corresponding to 300 ppm of exhaust gas as auxiliary fuel from an auxiliary fuel supply pipe was used. For each of the incineration methods, the use quantity of the auxiliary fuel (shown by the heating value of the auxiliary fuel per 1 kg of the sludge), a temperature of a free board part, a temperature of an incinerator outlet, a concentration of an exhaust gas component containing $N_2O$, and a total air ratio were measured, which are shown in Table 1.

TABLE 1

| | Unit | Ordinary incineration | High temperature incineration | Method of FIG. 1 | Method of FIG. 2 |
|---|---|---|---|---|---|
| Total heating value of auxiliary fuel | MJ/kg | 2.66 | 4.04 | 2.66 | 2.78 |
| Highest temperature of free board part | ° C. | 814 | 868 | 873 | 877 |
| Temperature of incinerator outlet | ° C. | 797 | 850 | 805 | 809 |
| CO concentration | ppm | 47 | 26 | 23 | 13 |
| $CO_2$ concentration | % | 9.1 | 9.4 | 14.4 | 14.9 |
| $N_2O$ concentration | ppm | 314 | 96 | 88 | 76 |
| Total air ratio | — | 1.40 | 1.34 | 1.23 | 1.19 |

As is apparent from the data, the present invention has an advantage that the quantity of $N_2O$ generated during sludge incineration can be drastically reduced while maintaining the use quantity of the auxiliary fuel at the same level as that of the conventional incineration method.

Example 2

As in the example 1, incineration experiments of sludge were conducted using a fluidized bed incinerator for an experiment while conditions were changed so that the use quantity of auxiliary fuel was further decreased. The quantity of the sludge fed was 80 kg/h in each of the incineration experiments. As the auxiliary fuel, heavy oil was used. For each of the incineration methods, the use quantity of the auxiliary fuel (shown by the heating value of the auxiliary fuel per 1 kg of the sludge), a temperature of a free board part, a temperature of an incinerator outlet, a concentration of an exhaust gas component containing $N_2O$, a total air ratio, a primary air ratio, and a secondary+third air ratio were measured, which are shown in Table 2.

TABLE 2

| | Unit | Ordinary incineration (1) | High temperature incineration | Ordinary incineration (2) | Method of FIG. 1 (Claims) | | | |
|---|---|---|---|---|---|---|---|---|
| Total heating value of auxiliary fuel | MJ/kg | 1.71 | 2.32 | 1.71 | 1.71 | 1.71 | 1.71 | 1.71 |
| Highest temperature of free board part | ° C. | 860 | 921 | 884 | 902 | 936 | 941 | 947 |
| Temperature of incinerator outlet | ° C. | 816 | 883 | 840 | 857 | 905 | 912 | 920 |
| CO concentration | ppm | 66 | 20 | 45 | 38 | 19 | 10 | 9 |
| $N_2O$ concentration | ppm | 258 | 61 | 158 | 101 | 27 | 16 | 13 |
| NOx concentration | ppm | 17 | 53 | 20 | 19 | 21 | 29 | 30 |
| Total air ratio | — | 1.4 | 1.4 | 1.3 | 1.3 | 1.3 | 1.3 | 1.3 |
| Primary air ratio | | 1.4 | 1.4 | 1.3 | 1.2 | 1.1 | 1.0 | 0.9 |
| Secondary + third air ratio | | — | — | — | 0.1 | 0.2 | 0.3 | 0.4 |

Data when the primary air ratio is sequentially reduced to 0.9 from 1.2 while keeping the total air ratio constant in the method of FIG. 1 are shown in Table 2. When the primary air ratio is set to 1.1 or less as in the present invention, it turns out that the $N_2O$ concentration in the exhaust gas is notably reduced as compared to the case where the primary air ratio is set to 1.2. As is apparent from the data, the example 2 has an advantage that the quantity of $N_2O$ generated during sludge incineration can be drastically reduced while maintaining the use quantity of the auxiliary fuel at the same level as that of the conventional incineration method.

The invention claimed is:

1. A fluidized bed incinerator for sludge comprising an incinerator body into which the sludge is supplied without drying, wherein an inside of the incinerator body is divided into a lower portion, a portion above the lower portion, and a top portion in a height direction;

the lower portion serves as a pyrolysis zone for thermally decomposing the sludge while supplying fluidizing air having an air ratio of 0.9 to 1.1 together with fuel to combust the fuel to fluidize the sludge, a fuel supply pipe is provided in the pyrolysis zone to supply fuel to the pyrolysis zone;

the portion above the lower portion serves as an over bed combustion zone for supplying only secondary combustion air having an air ratio of 0.1 to 0.3 to form a local high temperature place to decompose $N_2O$, the over bed combustion zone having a temperature higher than a temperature of the pyrolysis zone; and the top portion serves as a perfect combustion zone for perfectly combusting unburned contents.

2. The fluidized bed incinerator according to claim 1, wherein a sludge feed port is provided at a position higher than a secondary air supply pipe on a wall of the incinerator body.

3. The fluidized bed incinerator according to claim 1, wherein an air ratio of air supplied to the perfect combustion zone is set to 0.1 to 0.3, and an air ratio in total is set to 1.5 or less.

4. The fluidized bed incinerator according to claim 1, wherein a total air ratio of primary air supplied as the fluidizing air and secondary air supplied to the over bed combustion zone is set to 1.0 to 1.3.

5. The fluidized bed incinerator according to claim 1, wherein the temperature of the pyrolysis zone is set to 550 to 750° C.; and the temperature of the over bed combustion zone is set to 850 to 1000° C.

6. The fluidized bed incinerator for sludge according to claim 5, wherein an air ratio in total is 1.3 or less.

7. The fluidized bed incinerator according to claim 5, wherein a total air ratio of primary air supplied as the fluidizing air and secondary air supplied to the over bed combustion zone is set to 1.0 to 1.3.

8. The fluidized bed incinerator for sludge according to claim 1, wherein an auxiliary fuel reaction zone for supplying only auxiliary fuel to decompose $N_2O$ is formed between the over bed combustion zone and the perfect combustion zone.

9. The fluidized bed incinerator according to claim 8, wherein the temperature of the pyrolysis zone is set to 550 to 750° C.; and the temperature of the over bed combustion zone is set to 850 to 1000° C.

10. The fluidized bed incinerator according to claim 8, wherein a total air ratio of primary air supplied as the fluidizing air and secondary air supplied to the over bed combustion zone is set to 1.0 to 1.3.

11. The fluidized bed incinerator according to claim 8, wherein an air ratio of air supplied to the perfect combustion zone is set to 0.1 to 0.3, and an air ratio in total is set to 1.5 or less.

12. A fluidized bed incinerating method for sludge, comprising the steps of:

feeding the sludge into a fluidized bed incinerator;

thermally decomposing the sludge at a temperature of 550 to 750° C. while fluidizing the sludge in a pyrolysis zone into which fluidizing air having an air ratio of 0.9 to 1.1 is supplied together with fuel, a fuel supply pipe is provided in the pyrolysis zone to supply fuel to the pyrolysis zone;

blowing combustion air having an air ratio of 0.1 to 0.3 into pyrolysis gas at a position above the pyrolysis zone to form a local high temperature place of 850 to 1000° C. to decompose $N_2O$ in the pyrolysis gas; and blowing air into a top portion to perfectly combust unburned contents.

13. The fluidized bed incinerating method of claim 12 further comprising supplying fuel to an auxiliary fuel reaction zone above an over bed combustion zone to decompose $N_2O$.

14. A fluidized bed incinerating method for sludge, comprising the steps of:

feeding the sludge into a fluidized bed incinerator;

thermally decomposing the sludge at a temperature of 550 to 750° C. while fluidizing the sludge in a pyrolysis zone into which fluidizing air having an air ratio of 0.9 to 1.1 is supplied together with fuel, a fuel supply pipe is provided in the pyrolysis zone to supply fuel to the pyrolysis zone;

blowing combustion air having an air ratio of 0.1 to 0.3 into pyrolysis gas at a position above the pyrolysis zone to form a local high temperature place of 850 to 1000° C. to decompose $N_2O$ in the pyrolysis gas; and supplying only auxiliary fuel into an auxiliary fuel reaction zone above the position above the pyrolysis zone to decompose residual $N_2O$; and blowing air into a top portion to perfectly combust unburned contents.

15. The fluidized bed incinerating method for sludge according to claim 14 wherein a total air ratio is 1.5 or less.

* * * * *

UNITED STATES PATENT AND TRADEMARK OFFICE

CERTIFICATE OF CORRECTION

PATENT NO. : 8,881,662 B2
APPLICATION NO. : 12/758166
DATED : November 11, 2014
INVENTOR(S) : Masaki Yamada et al.

It is certified that error appears in the above-identified patent and that said Letters Patent is hereby corrected as shown below:

Title page

Item (73) Assignee:

Please change: "Metawater Co., Ltd., Minato-Ku (JP)" to -- Metawater Co., Ltd., Chiyoda-Ku (JP) --

Signed and Sealed this
Fifth Day of January, 2016

Michelle K. Lee

Michelle K. Lee
*Director of the United States Patent and Trademark Office*